US005666913A

United States Patent [19]

Gustafson et al.

[11] Patent Number: 5,666,913

[45] Date of Patent: Sep. 16, 1997

[54] VARIABLE TIMING CAM FOLLOWER LEVER ASSEMBLY

[75] Inventors: Richard J. Gustafson; Corydon E. Morris, both of Columbus, Ind.

[73] Assignee: Cummins Engine Company, Inc., Columbus, Ind.

[21] Appl. No.: 654,930

[22] Filed: May 29, 1996

[51] Int. Cl.[6] ..... F01L 1/34

[52] U.S. Cl. ..... 123/90.16; 123/90.34; 123/500; 123/502

[58] Field of Search ..... 123/90.15, 90.16, 123/90.39, 500, 501, 502, 503

[56] References Cited

U.S. PATENT DOCUMENTS

| | | | |
|---|---|---|---|
| 3,859,973 | 1/1975 | Dreisin | 123/90.17 |
| 4,187,810 | 2/1980 | Buehner | 123/90.16 |
| 4,206,734 | 6/1980 | Perr et al. | 123/502 |
| 4,306,528 | 12/1981 | Straubel et al. | 123/357 |
| 4,531,672 | 7/1985 | Smith | 239/89 |
| 4,607,600 | 8/1986 | Yoshizaki | 123/90.16 |
| 4,721,007 | 1/1988 | Entzminger | 123/90.16 |
| 4,986,472 | 1/1991 | Warlick et al. | 239/88 |
| 5,003,939 | 4/1991 | King | 123/90.16 |
| 5,046,462 | 9/1991 | Matayoshi et al. | 123/90.16 |
| 5,107,803 | 4/1992 | Furnivall | 123/90.16 |
| 5,111,781 | 5/1992 | Kaku et al. | 123/90.16 |
| 5,113,813 | 5/1992 | Rosa | 123/90.16 |
| 5,189,997 | 3/1993 | Schneider | 123/90.16 |
| 5,251,586 | 10/1993 | Koga et al. | 123/90.16 |
| 5,365,895 | 11/1994 | Riley | 123/90.16 |

FOREIGN PATENT DOCUMENTS

| | | |
|---|---|---|
| 60-90905 | 5/1985 | Japan . |
| 60-230504 | 11/1985 | Japan . |
| 2066403 | 7/1981 | United Kingdom . |

*Primary Examiner*—Weilun Lo

*Attorney, Agent, or Firm*—Sixbey, Friedman, Leedom & Ferguson; Charles M. Leedom, Jr.; Tim L. Brackett, Jr.

[57] ABSTRACT

A cam follower lever assembly is provided which permits variable control of the timing of the beginning of operation of an engine component, i.e. fuel injector or engine valve. The cam follower lever includes a timing control lever and a force transmitting lever mounted for pivotal movement on a common pivot shaft. The timing control lever is also mounted for nonpivotal movement, relative to the pivot shaft, by a hydraulic actuation device permitting selective nonpivotal movement of the timing control lever relative to a cam's outer surface so as to selectively advance or retard the timing of, for example, fuel injection. The actuation device includes actuator cavities formed in the levers and a control valve arrangement. In one embodiment, a control valve is mounted in a cavity formed in the timing control lever.

25 Claims, 4 Drawing Sheets

VARIABLE TIMING CAM FOLLOWER LEVER ASSEMBLY

TECHNICAL FIELD

The present invention relates generally to a cam follower lever assembly for enabling operation of a unit fuel injector while permitting variable control of the timing of injector operation and, therefore, the timing of fuel injection.

BACKGROUND OF THE INVENTION

Commercially competitive fuel injector systems of the future will almost certainly need some capacity for controlling the timing of commencement of injection in response to changing engine conditions in order to achieve acceptable pollution abatement and fuel efficiency. Certainly, some emission control standards will be difficult or impossible to meet unless timing of fuel injection can be variably controlled extremely accurately on a cycle-by-cycle basis depending on operator demand and/or engine conditions.

Likewise, numerous attempts have been made to design a unit injector system which provides for variable timing. For example, many conventional unit fuel injectors include a multi-plunger arrangement having a timing chamber into which a variable quantity of timing fluid is supplied to form a hydraulic link between the plungers, the length of which is varied to change the injection timing. U.S. Pat. No. 4,986,472 to Warlick et al. and U.S. Pat. No. 4,531,672 to Smith disclose representative examples of unit injectors using variable hydraulic timing links to variably control injection timing. These types of unit fuel injectors have proven themselves to be reliable and effective, and have played a significant role in improving engine emissions without sacrificing fuel economy and power. Nonetheless, the use of a hydraulic link is not without its disadvantages. The hydraulic links found in these prior art fuel injectors are subject to parasitic losses and high pressure leakage. The parasitic losses are reflected in the high temperature of the fuel (which also serves as the timing fluid) which is spilled when the timing chamber is emptied each cycle, and which otherwise leaks, back to the fuel supply system. The amount of heat absorbed by the fuel and ultimately the temperature of the fuel in the fuel supply tank has been found to increase to an unacceptably high level due to higher injection pressures. These higher injection pressures are necessary to improve fuel economy and reduce emissions thereby enabling engine manufacturers to meet strict emission standards set by recent and upcoming legislation. However, the high temperature of the spill and leakage fuel is a prime reason why many known high pressure fuel systems currently require costly, undesirable fuel coolers.

Additionally, multi-plunger type fuel injectors having a variable volume timing chamber have a variable overtravel and an inherent effect of varying the timing by changing the length of a hydraulic link is that the injection event occurs at a different point on the cam shaft when, e.g., the timing is retarded than when it is advanced. This has the effect of causing the injection event to occur at a higher camshaft velocity with an advanced engine timing than at a retarded engine timing, which results in a change in the injection pressure being associated with such a timing change. To meet future emissions and performance requirements, it now appears that it will be necessary to be able to control injection pressure independently of injection timing, thereby enabling, for example, the injection pressure to be maintained constant despite a change in timing.

A fuel injection system which does not utilize a hydraulic link for timing purposes is described in U.S. Pat. No. 4,206,734 to Perr et al. The adjustable timing mechanism for the fuel injection system of this patent utilizes a shaft having an eccentric portion which rotates to move a cam follower with respect to a cam to vary the timing of injection of a fuel injector. The mechanism is designed to ensure that the rocker arm and injector plunger remain in essentially the same position at the end of the injection stroke regardless of the setting of the timing, thus allowing the timing to be adjusted during operation of the injector while ensuring a substantially constant mechanical load on the injector. However, timing adjustment using the device disclosed in this Perr et al. patent does cause small changes in the position of the rocker arm and injector plunger, and thus, changes, to some degree, the mechanical load or "crush" on the injector body. Furthermore, this device requires the controlled rotation of the eccentric shaft to vary timing. Moreover, the actuating arrangement for controlling the rotation of the eccentric shaft, which is designed to mount to the side of the engine, requires arm and linkage arrangements imposing undesirably large space requirements.

U.S. Pat. No. 4,306,528 to Straubel et al. discloses an injection pressure and timing control device that includes a timing setting device that is connected to a multi-plunger unit injector for controlling the onset of injection, and an injector drive and timing correction apparatus connected to an injector rocker arm for correcting, or compensating for, excessive or undesired variations in the timing of injection caused by the timing setting device, thus allowing the injection pressure to be controlled independently of the engine speed. In particular, the timing setting device controls the amount of fluid in a timing chamber to form a variable length hydraulic link, and the injector drive and timing correction apparatus may include an actuator arm that pivots a rotatable eccentric shaft for advancing or retarding the injection timing by shifting a drive lever which forms a cam follower disposed between the timing cam and a connecting link acting on the rocker arm. However, this arrangement cannot assure that the rocker arm remains in essentially the same position at the end of the injection stroke regardless of the timing setting. Moreover, this device requires the controlled movement of an eccentric shaft to vary timing of injection.

U.S. patent application Ser. No. 527,346 filed Sep. 12, 1995 entitled Variable Injection Timing and Injection Pressure Control Arrangement and assigned to the assignee of the present invention, discloses a variable timing cam follower lever arrangement including a cam follower which is moved relative to an actuating cam so as to control the timing of fuel injection. However, this arrangement requires the rotation or movement of an eccentric shaft to move the follower lever.

U.S. Pat. No. 5,107,803 to Furnivall discloses a two-piece rocker arm including a cam engaging arm and a valve engaging arm pivotally mounted on a rocker shaft wherein the valve engaging arm includes oil passages and a cavity for receiving a piston. This arrangement automatically permits changes in valve timing by controlling the oil pressure in the passages and the piston cavity so as to control the relative movement between the engaging arms of the rocker arm. However, this device is used to vary valve lift and, therefore, could not be used to operate a unit injector without causing structural failure to the injector due to excessive crush loads by the injector plunger on the injector body. U.S. Pat. No. 5,113,813 to Rosa discloses a similar device for providing variable valve timing and lift.

Consequently, there is a need for a cam follower lever assembly capable of effectively operating a unit fuel injector or an engine valve without significantly affecting injector plunger travel and valve lift respectively, while also permitting variable control of the timing of injector or valve operation.

SUMMARY OF THE INVENTION

It is an object of the present invention, therefore, to overcome the disadvantages of the prior art and to provide a simple, low cost cam follower lever mechanism which permits controlled variations in the timing of operation of an engine component.

It is another object of the present invention to provide a cam follower lever mechanism permits the timing of engine component operation, i.e. fuel injector, valve, or compression brake, to be variably controlled relative to engine operation without varying the outer extension limit of the engine component movement during each rotation of a cam.

It is yet another object of the present invention to provide a cam follower lever mechanism which permits controlled variations in fuel injection timing in unit fuel injection systems without the use of multiplunger injectors.

It is a further object of the present invention to provide a cam follower lever mechanism which permits controlled variations in timing of fuel injection by unit injectors while minimizing the amount of high temperature fuel directed from the injector to drain.

It is a still further object of the present invention to provide a cam follower lever mechanism capable of permitting infinite variations in the timing of engine component operation.

Still another object of the present invention to provide a cam follower lever mechanism for permitting two-step timing control including simple and quick changeover from a preset advanced timing to a preset retarded timing and vice versa.

Yet another object of the present invention to provide a cam follower lever mechanism capable of being mounted for effective operation in an engine overhead for overhead cam engines, or alternatively, lower in the engine for lower mounted cam engines typically using a push tube to operate engine components.

These and other objects are achieved by providing a cam follower lever assembly or mechanism for transmitting an actuating force from a cam, having an outer surface, to an engine component so as to move the engine component through an actuation stroke having a predetermined outer extension limit during each rotation of the cam while permitting variations in the timing of operation of the engine component. The cam follower lever mechanism comprises a pivot mounted adjacent the cam to define a pivot axis and a follower lever mounted on the pivot support for pivotal movement about the pivot axis wherein the follower lever includes a timing control lever mounted for nonpivotal movement relative to the pivot axis. The timing control lever includes a first end pivotally connected to the pivot support and second end positioned for abutment against the cam outer surface. The nonpivotal movement of the timing control lever causes the second end to move along the cam outer surface while maintaining the pivot axis stationary relative to the cam and maintaining the predetermined outer extension limit of the actuation stroke substantially constant. The follower lever may include a force transmitting lever having a pivot end pivotally connected to the pivot support and a support end positioned adjacent the second end of the timing control lever for receiving the actuating force from the timing control lever. The pivot end of the force transmitting lever may include a first arm pivotally mounted on the pivot support and a second arm pivotally mounted on the pivot support a spaced distance from the first arm. The first end of the timing control lever being mounted on the pivot support between the first and second arms. The cam follower lever mechanism may further include an actuating device for causing the nonpivotal movement of the timing control lever along the outer surface of the cam to vary the timing of operation of the engine component. The actuating device may include a pressurized supply of actuating fluid and at least one actuator cavity formed in the timing control lever for receiving actuating fluid. The actuating device may also include a control valve for varying the amount of fluid in the actuator cavity to cause the nonpivotal movement of the first end of the timing control lever. The actuating device may further include a first actuator cavity formed in the timing control lever on one side of the pivot support for receiving actuating fluid and a second actuator cavity formed on an opposite side of the pivot support. The first end of the timing control lever may include an oblong aperture for receiving the pivot shaft and sealing surfaces defining the oblong aperture for creating a fluid seal between the pivot support or shaft and the timing control lever to prevent fluid leakage between the first and second actuator cavities. In one embodiment, the control valve may include a valve cavity formed in the timing control lever and a spring-biased valve plunger positioned in the valve cavity. This embodiment may further include fluid supply passages formed in the pivot support and the timing control lever for delivering actuating fluid to the valve cavity. Also, fluid transfer passages may be formed in the timing control lever for connecting the valve cavity with the actuator cavities. The actuating device may further include a pressure regulator for selectively varying the supply pressure of the actuating fluid delivered to the valve cavity. In this manner, the valve plunger is movable in response to changes in the supply pressure to vary the amount of fluid in the actuator cavities. This embodiment provides infinitely variable control of the timing of operation of the engine component.

In a second embodiment, the pivot support includes a first fluid transfer passage communicating with a first actuator cavity and a second fluid transfer passage communicating with a second actuator cavity for transferring fluid into and out of the first and second cavities, respectively. The control valve device is no longer positioned in the timing control lever, but is positioned upstream of the fluid transfer passages to control the flow into and out of the cavities. This arrangement results in a simpler control lever design and permits two-step timing control between a preset advanced timing setting and a preset retarded timing setting.

DETAILED DESCRIPTION OF THE PREFERRED EMBODIMENT

Figure 1:
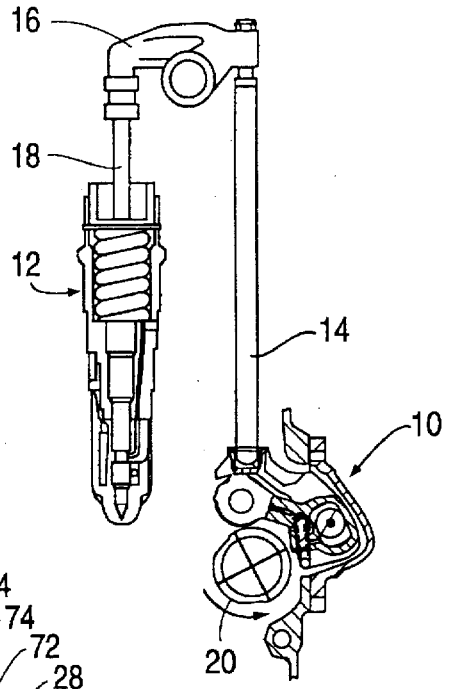
FIG. 1 is a partial cross-sectional side view of the cam follower lever mechanism of the present invention as applied to a unit fuel injector operated via a push rod/rocker arm assembly.

Referring to FIG. 1, there is shown the variable timing cam follower mechanism or assembly of the present invention indicated generally at 10 as applied to a unit fuel injector 12 operated via a push rod 14, rocker lever 16 and a link 18. Injector 12, as shown, is of the open nozzle type, such as disclosed in U.S. Pat. No. 4,280,659 to Gaal et al., commonly assigned to the assignee of the present invention and which is hereby incorporated by reference. This specific type of fuel injector includes a single pumping plunger mechanically connected to the drive train via link 18. Alternatively, cam follower lever mechanism 10 may be used to actuate other types of injectors and engine components. For example, cam follower lever mechanism 10 may be used to variably control the timing of operation of a plunger incorporated in a closed nozzle fuel injector. In addition, mechanism 10 may be used to variably actuate a unit injector having a variable volume timing chamber positioned between two plungers such as disclosed in U.S. Pat. No. 4,986,472 to Warlick et al. and 4,531,672 to Smith, both commonly assigned to the assignee of the present invention. The distinct advantages of combining the cam follower lever mechanism 10 of the present invention with variable volume type unit injectors will be discussed in detail hereinbelow. Also, follower lever mechanism 10 may be used to variably control the timing of operation of engine intake and exhaust valves. Regardless of the engine component, cam follower mechanism 10 may actuate the engine component via push rod 14 shown in FIG. 1, or, alternatively, may be positioned in the engine overhead between an overhead cam and rocker lever 16 thereby eliminating the need for push rod 14.

Cam follower lever assembly 10 is designed to permit the timing of the beginning of actuation of the engine component, i.e. fuel injector, to be varied, i.e. advanced or retarded, based on engine operating conditions. Thus, the timing of the beginning of fuel injection relative to the stroke of an engine piston can be varied based on engine conditions to optimize the combustion process for a given set of engine conditions thereby permitting reduced emissions and improved fuel efficiency. Likewise, assembly 10 may be used to vary the beginning of intake or exhaust valve opening to also reduce emissions and improve fuel consumption.

Figure 2:
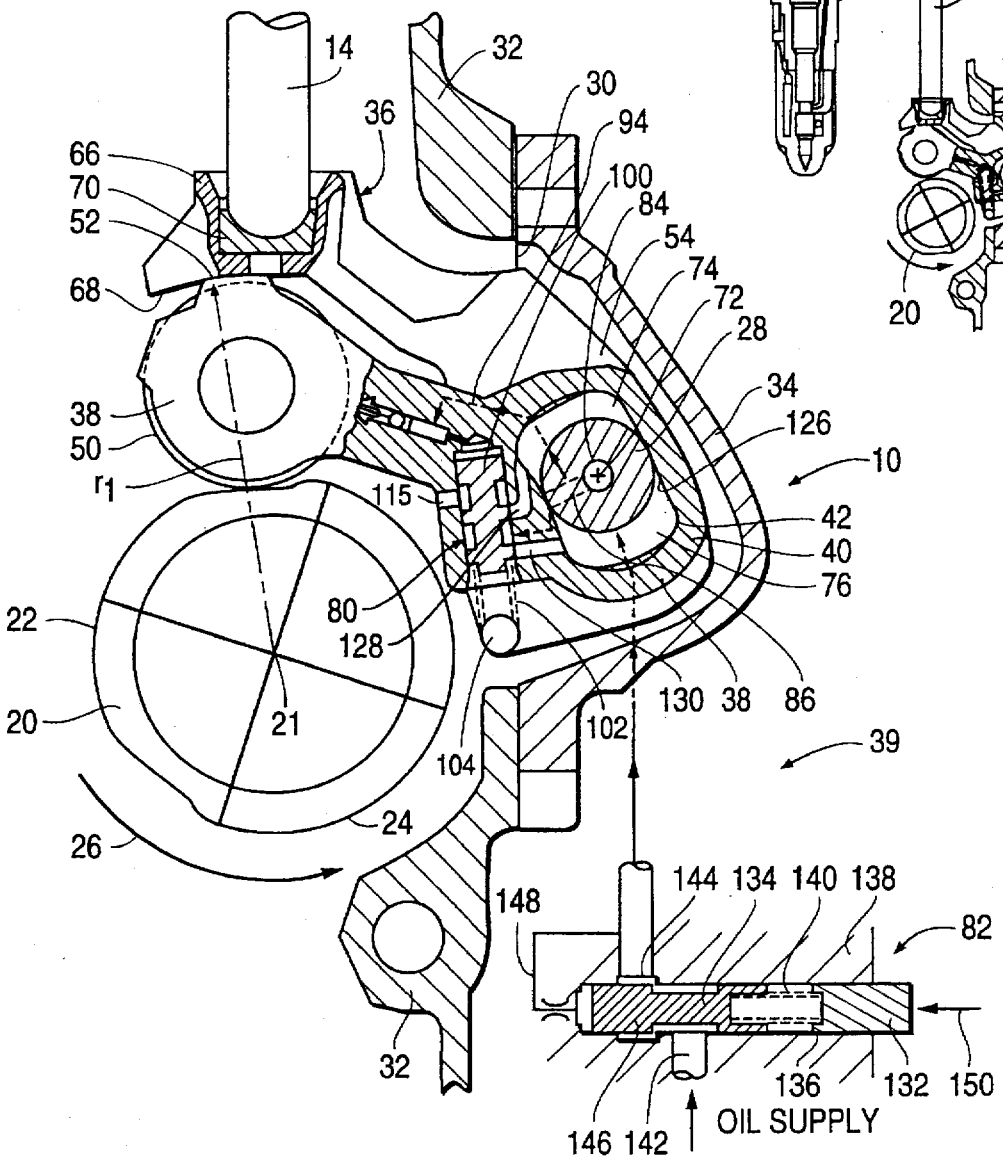
FIG. 2 is a partial cross-sectional view of cam follower lever mechanism as shown in FIG. 1.

As shown in FIGS. 1 and 2, cam follower lever assembly 10 is positioned adjacent a cam 20 having an inner base circle 22 and an outer base circle 24. Rotation of cam 20 in the counterclockwise direction as indicated by arrow 26 causes cam 20 to impart an actuating force on push rod 14 via cam follower lever assembly 10. Cam follower lever assembly 10 is mounted on a pivot support or shaft 28 extending along the engine parallel to a cam shaft associated with cam 20. Cam follower lever assembly 10 extends through an opening 30 formed in an engine cylinder block 32. A cover 34 is placed over assembly 10 and pivot shaft 28 so as to seal opening 30 from the outside environment thereby enclosing assembly 10 in the crank case of the engine.

Figure 5A:
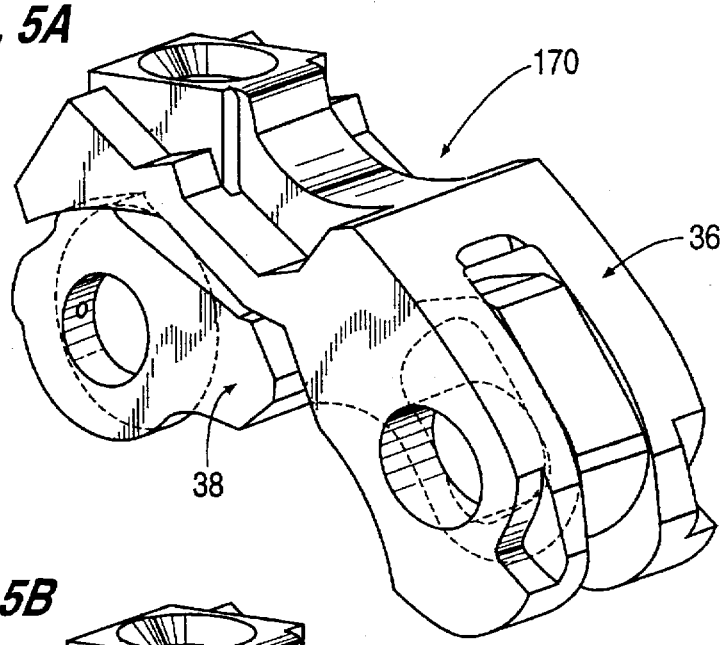
FIG. 5A is an assembled elevational view of the second embodiment of the cam follower lever mechanism shown in FIGS. 4A and 4B.
Figure 5B:
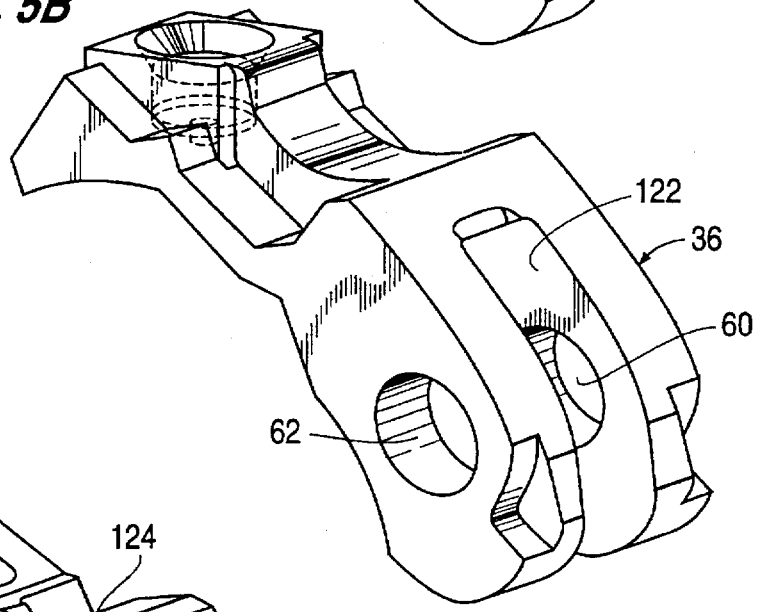
FIG. 5B is an elevational view of the force transmitting lever of the cam follower shown in FIG. 5A.
Figure 5C:
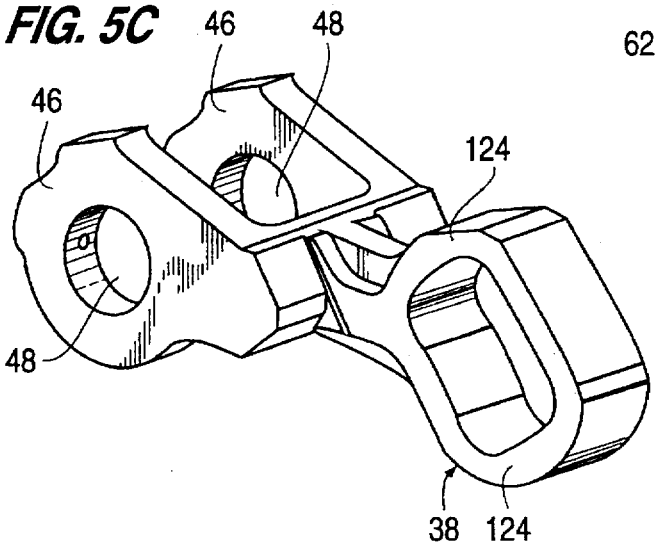
FIG. 5C is an elevational view of the timing control lever of the cam follower shown in FIG. 5A.

As shown in FIGS. 2 and 5A–5C cam follower lever assembly 10 generally includes a force transmitting lever 36, a timing control lever 38 both pivotally mounted on pivot shaft 28 and an actuating device 39. Although FIGS. 5A–5C illustrate a second embodiment of the present lever assembly to be discussed in more detail hereinbelow, FIGS. 5A–5C accurately illustrate the general structure of force transmitting lever 36 and timing control lever 38 of the first embodiment shown in FIG. 2. Therefore FIGS. 5A–5C may be referenced to more completely understand the lever assembly of both embodiments. Like features of the first and second embodiments are indicated with the same reference numerals.

Figure 3:
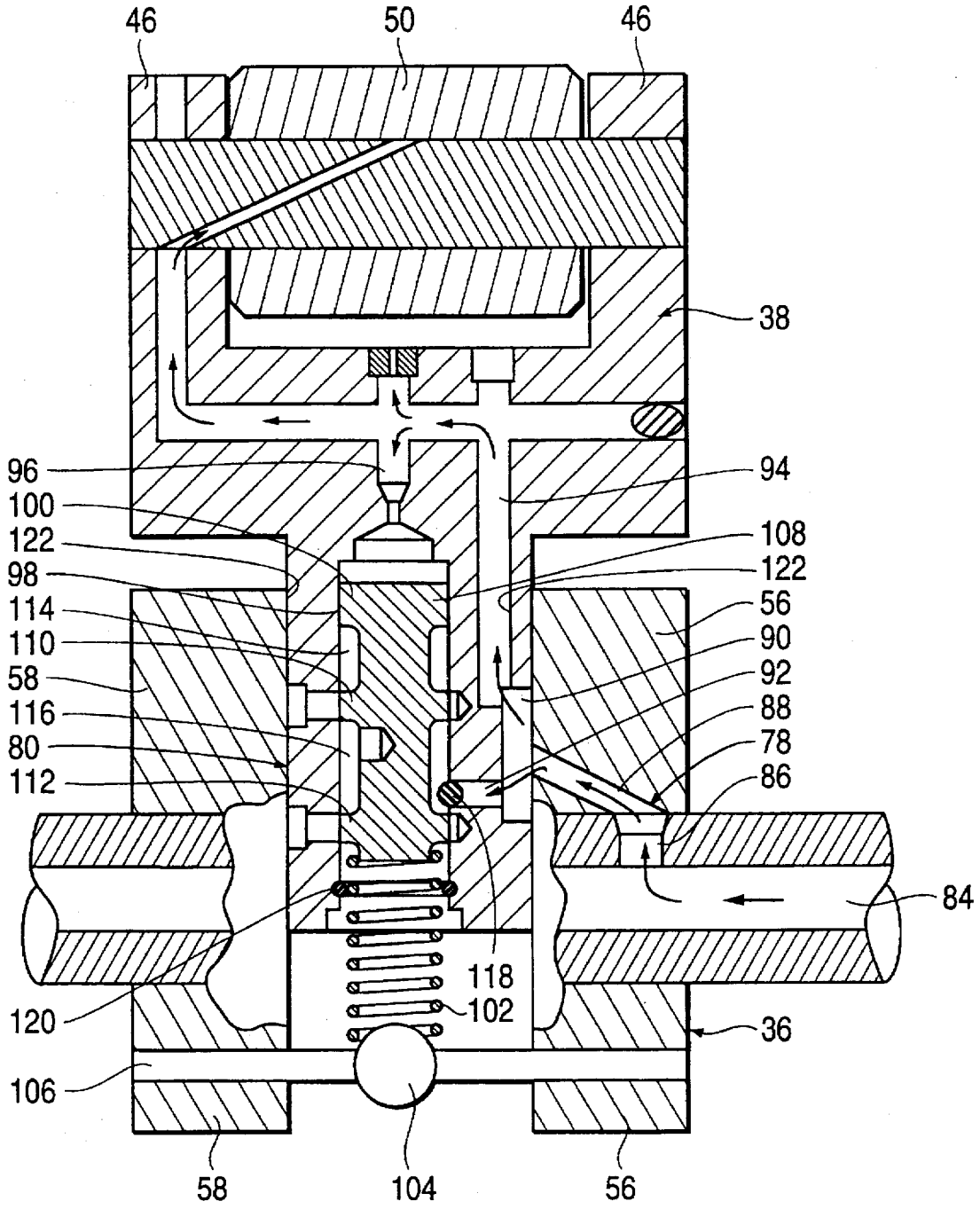
FIG. 3 is a cross-sectional schematic of the cam follower lever mechanism of the present invention showing actuating fluid supply and transfer passages.

As shown in FIGS. 2, 3 and 5C, timing control lever 38 includes a first end 40 having an oblong aperture 42 through which pivot shaft 28 extends. An opposite or second end 44 of timing control lever 38 extends toward cam 20 and includes a pair of extensions 46, each having a mounting aperture 48 (FIG. 5C) extending therethrough for mounting a roller 50. Roller 50 is rotatably supported by extensions 46 for abutment against the outer surface of cam 20. Each of extensions 46 also include a mating surface 52 for abutting force transmitting lever 36 during operation of assembly 10.

Force transmitting lever 36 includes a pivot end 54 formed by first and second arms 56 and 58, respectively. Arms 56, 58 include aligned apertures 60, 62 sized to receive pivot shaft 28 so as to permit pivoting of force transmitting lever 36 while creating a fluidically sealed connection. First end 40 of timing control lever 38 is mounted on pivot shaft 28 between first and second arms 56, 58. Force transmitting lever 36 extends away from support shaft 28 to form a support end 66 having a force transmitting surface 68 positioned for abutment by mating surface 52. Support end 66 also includes a semi-spherical recess for receiving a complimentary shaped end of push rod 14. Thus, both the force transmitting lever 36 and timing control lever 38 are pivotally mounted on pivot shaft 28 for pivotal movement about the pivot axis 72 extending through shaft 28 so as to transmit an actuating force from cam 20 to push rod 14 and rocker lever 16, link 18 and the plunger of injector 12, or the reciprocating mechanism of another engine component, such as an engine valve.

Referring to FIGS. 2 and 3, the actuating device 39 generally includes a pressurized supply of actuation fluid, i.e. lube oil, first and second actuator cavities 74 and 76, respectively, and an actuation fluid circuit indicated generally at 78 for delivering actuating fluid from the pressurized supply to actuator cavities 74, 76. Actuating device 39 also includes the control valve 80 for varying the amount of fluid in the actuator cavities 74, 76 in response to changes in the actuation fluid pressure. Actuating device 39 further includes a pressure regulator 82 positioned along actuation fluid circuit 78 upstream of control valve 80 for selectively varying the supply pressure of the actuating fluid delivered to control valve 80. As it can be appreciated, due to the oblong shape of aperture 42 and thus the presence of actuator cavities 74 and 76, timing control lever 38 is capable of nonpivotal movement relative to pivot axis 72. Actuating device 39 controls this nonpivotal movement of timing control lever 38 relative to pivot axis 72 so as to move second end 44 timing control lever 38 along the outer surface of cam 20 thereby varying the timing of operation of the engine component actuated via push rod 14.

Referring to FIGS. 2 and 3, actuation fluid circuit 78 includes a center passage 84 extending axially through pivot shaft 28 for delivering pressurized actuating fluid from a pressurized source, such as the engine lube oil system. A connector passage 86 extends transversely through pivot shaft 28 to connect with a supply passage 88 formed in first arm 56 of force transmitting lever 36 as shown in FIG. 3. A supply port 90, formed in the outer surface of the first end 40 of timing control lever 38 facing first arm 56, connects supply passage 88 with a first inlet passage 92 and a delivery passage 94 connected to a second inlet passage 96.

Control valve 80 includes a valve cavity 98 formed in the first end 40 of timing control lever 38 and a valve plunger 100 reciprocally mounted in valve cavity 98. The inner end of valve cavity 98 communicates with second inlet passage 96 while the outer end opens to the engine crank case. Plunger 100 is slidably mounted in valve cavity 98 and biased inwardly by a coil spring 102 having one end positioned in abutment against plunger 100 and an opposite end positioned against a spring seat 104. Spring seat 104 is formed on an elongated support 106 connected to force transmitting lever 36. Plunger 100 includes first, second and third lands 108, 110 and 112 respectively which slidably engage the inner wall of forming valve cavity 98 to create a fluid seal. First land 108 and second land 110 are separated by an annular drain groove 114 which continually communicates with a drain passage 115 formed in timing control lever 38 to direct fluid from groove 114 to the engine crank case. Second land 110 and third land 112 are separated by a supply groove 116 formed in plunger 100 so as to communicate with first inlet passage 92. An inlet check valve 118 positioned in first inlet passage 92 prevents the backflow of fluid from annular supply groove 116 into first inlet passage 92. A plunger stop 120 is positioned in a groove formed in the outer end of valve cavity 98 for limiting the outer movement of plunger 100. First and second actuator cavities 74 and 76 are formed on opposite sides of pivot shaft 28 between first and second arms 56 and 58 of force transmitting lever 36 and within the oblong aperture 42 formed in timing control lever 38. The inner surfaces 122 of first and second arms 56, 58 and the facing outer surfaces 124 (FIG. 5C) formed on timing control lever 38 which contact inner surfaces 122 (FIG. 5B), are all precision machined to provide a fluidically sealed sliding fit between first end 40 of timing control lever 38 and first and second arms 56, 58 of force transmitting lever 36. Thus, a seal is formed to prevent fluid leakage from first and second actuator cavities 74, 76 thereby maintaining a predetermined amount of fluid in the respective cavities and thus a predetermined hydraulic link between timing control lever 38 and pivot shaft 28. In addition, a portion of the inner opposed surfaces 126 of timing control lever 38 which define oblong aperture 42 and which contact pivot shaft 28 are also precision sealing surfaces for creating a fluid seal between the outer surface of pivot shaft 28 and timing control lever 38 so as to prevent leakage between first and second actuator cavities 74, 76. Of course, the outer surface of pivot shaft 28 must also be of a sufficient size and smoothness to create such a seal while permitting nonpivotal movement of timing control lever 38 relative to pivot shaft 28.

A first fluid transfer passage 128 formed in timing control lever 38 fluidically connects valve cavity 98 to first actuator cavity 74. A second fluid transfer passage 130 formed in timing control lever 38 fluidically connects valve cavity 98 to second actuator cavity 76. As shown in FIGS. 2 and 3, with valve plunger 100 in an equilibrium position, second land 110 blocks fluid flow through first fluid transfer passage 128 while third land 112 blocks fluid flow through second fluid transfer passage 130 thereby maintaining predetermined respective amounts of fluid in first and second actuator cavity 74, 76. Thus, at a given supply pressure, with valve plunger 100 in an equilibrium, balanced position, timing control lever 38 will not undergo nonpivotal movement relative to pivot shaft 28 but will pivot about pivot axis 72 as cam 20 rotates.

Pressure regulator 82 may be any pressure regulating device capable of permitting selective variations in the supply pressure to actuation fluid circuit 78. In the embodiment shown in FIG. 2, pressure regulator 82 includes an input plunger 132 and a floating plunger 134 mounted coaxially in a bore 136 formed in a housing 138. Plungers 132 and 134 are biased apart by a spring 140. A fluid supply passage 142 communicates with bore 136 while an outlet passage 144 directs fluid from bore 136 to center passage 84. Floating plunger 134 includes an annular land 146 positioned to control the flow of fluid from supply passage 142 to outlet passage 144. The inner end of bore 136 adjacent floating plunger 134 is fluidically connected to outlet passage 144 via a return circuit 148. A variable input force indicated by arrow 150 is applied to input plunger 132 to set and vary the supply pressure delivered from pressure regulator 82 to actuation fluid circuit 78 and thus valve cavity 98. Variable input force 150 may be any variably controlled force generated mechanically, electrically and/or hydraulically. Pressure regulator 82 operates similar to a conventional regulator in that an increased input force on input plunger 132 increases the force on floating plunger 134 thus moving plunger 134 to the left as shown in FIG. 2. As a result, land 146 uncovers outlet passage 144 allowing supply fluid flow from passage 142 into passage 144. As the fluid pressure in outlet passage 144 increases, so does the fluid pressure on the end of floating plunger 134 which in turn moves floating plunger 134 to the right as shown in FIG. 2 returning regulator 82 to a balanced position blocking the flow from supply passage 142. Thus, each input force applied at 150 results in a corresponding outlet fluid pressure from pressure regulator 82.

The operation of the first embodiment of the present invention will now be described with reference to FIGS. 1–3. As shown in FIG. 2, assuming a constant input force at 150, the actuation fluid supply pressure delivered to valve cavity 98 is maintained at a constant pressure and thus valve plunger 100 is positioned in a balanced position wherein the fluid forces acting on the inner end of plunger 100 are balanced by the spring force of spring 102. In this balanced position, second land 110 and third land 112 block fluid flow through first fluid transfer passage 128 and second fluid transfer passage 130, respectively. Thus, the actuating fluid in first actuator cavity 74 and second actuator cavity 76 is maintained to create a hydraulic link between pivot shaft 28 and timing control lever 38 which prevents nonpivotal movement of timing control lever 38 relative to pivot shaft 28. As cam 20 rotates, the outer surface of cam 20 imparts an actuating force on roller 50 causing timing control lever 38 to pivot about pivot shaft 28. Therefore, timing control lever 38 is permitted to pivot about pivot axis 72 without moving in a nonpivotal manner relative to pivot axis 72. Mating surface 52 of timing control lever 38 is in constant contact with force transmitting surface 68 of force transmitting lever 36 so as to transmit the actuation force to support end 66. Consequently, force transmitting lever 36 pivots with timing control lever 38 about pivot axis 72 thus imparting the actuation force on push rod 14 which in turn operates rocker lever 16. Rocker lever 16 then translates the upward actuation force from push rod 14 into a downward force on link 18 and the injector plunger(s) of injector 12. As the injector plunger moves downwardly, fuel in the metering chamber of the injector is injected into the combustion chamber of the engine (not shown). Therefore, when timing control lever 38 is fixed in a single timing position incapable of nonpivotal movement relative to pivot axis 72, the point at which the peripheral surface of roller 50 rides on the outer base circle of cam 20 is also fixed relative to the cam axis 21. As a result, the timing of the beginning of the transmission of an actuation force from cam 20 to the injector plunger via cam follower lever assembly 10 and the injector drive train, is maintained constant relative to the rotation of the cam and thus other related engine operation such as the movement of the engine piston and the engine cylinder (not shown).

The present invention is capable of effectively and reliably shifting the position of the timing control lever 38 relative to the outer surface of cam 20 and thus relative to cam axis 21 to vary the timing of the beginning of transmission of the actuation force and thus the timing of fuel injection when applied to a unit fuel injector. Also, the cam follower lever assembly 10 achieves this relative nonpivotal movement of timing control lever 38 while maintaining substantially constant injector plunger "crush" by ensuring the injector plungers move to a substantially constant maximum outer extension or stroke limit as described more fully hereinbelow.

Referring to FIG. 2, nonpivotal movement of timing control lever 38 to adjust the timing of operation of the engine component, i.e. fuel injector, is achieved by varying the input force 150 on pressure regulator 82. An increase in input force 150 ultimately advances the timing of fuel injection while a decrease in input force 150 will result in retarding the timing of fuel injection. Specifically, an increase in input force 150 will result in an increase in the actuation fluid pressure in outlet passage 144 downstream of pressure regulator 82 and thus an increase in fluid pressure in center passage 84, connector passage 86, supply passage 88, port 90, delivery passage 94 and second inlet passage 96. The increased actuation fluid pressure thus acts on the inner end of plunger 100 to move plunger 100 downwardly as shown in FIGS. 2 and 3 causing third land 112 to uncover second fluid transfer passage 130 thereby connecting supply groove 116 to second actuator cavity 76 via passage 130. Thus actuating fluid flows through inlet passage 92 and inlet check valve 118 into second actuator cavity 76. Simultaneously, second land 110 uncovers first fluid transfer passage 128 causing fluid to flow from first actuator cavity 74 through passage 128 into annular drain groove 114 and onward into the crank case via drain passage 115. The pressurized actuation fluid in second actuator cavity 76 acts on timing control lever 38 so as to move timing control lever 38 in a nonpivotal manner relative to pivot shaft 28 increasing the size of second actuator cavity 76 and decreasing the size of first actuator cavity 74. This nonpivotal movement of timing control lever 38 causes the second end 44 of lever 38 to shift along the outer surface of cam 20 in a clockwise direction. Timing control lever 38 will nonpivotally shift until first and second fluid transfer passages 128 and 130 move into a position wherein second and third lands 110 and 112 cover or block transfer passages 128 and 130, respectively. This position results from the movement of timing control lever 38 relative to valve plunger 100. Thus, control valve 80 and timing control lever 38 function as a hydraulic servo-type valve. At this point, cam follower lever assembly 10 has again reached a balanced position with a more advanced timing mode relative to the previous setting. As should be understood, the timing of injection may be retarded by decreasing input force 150 to decrease the supply pressure delivered to valve cavity 98. In response, valve plunger 100 moves upwardly as shown in FIGS. 2 and 3 connecting second fluid transfer passage 130 to drain via valve cavity 98 while connecting first cavity 74 to the pressurized supply of actuating fluid via supply groove 116 and first transfer passage 128. As a result, timing control lever 38 will move in a counterclockwise direction along the outer surface of cam 20 until second and third lands 110 and 112 block fluid flow through first and second fluid transfer passages 128 and 130, respectively.

FIGS. 4A, 4B, 5A and 5B illustrate a second embodiment of the present cam follower lever assembly which is similar to the first embodiment except that only two timing positions are available to provide a more simplified system. The cam follower assembly 170 includes timing control lever 38 and force transmitting lever 36 as described hereinabove with respect to the first embodiment. However, instead of the pressure regulated control valve of the first embodiment, an actuation device 172 includes an actuation circuit 174 including a first fluid transfer passage 176 formed in the pivot shaft 175 and connected to first actuator cavity 74, a second fluid transfer passage 178 formed in pivot shaft 175 and connected to second actuator cavity 76, and first and second actuator valves 180, 182 positioned upstream of first and second fluid transfer passages 176, 178, respectively. Respective connector passages 177, 179 connect first and second fluid transfer passages 176, 178 to the respective cavities. First and second actuator valves 180, 182 are each operable to connect the respective actuator cavity to a supply of pressurized fluid or to a drain depending on the timing mode desired. For example, first and second actuator valves 180, 182 may be three-way, two position solenoid operated valves. During operation, if advanced timing is desired (FIG. 4A), first actuator valve 180 is operated to connect first actuator cavity 74 to drain while second actuator valve 182 is operated to connect pressurized actuation fluid to second actuator cavity 76. The pressurized fluid forces acting on timing control lever 38 in cavity 76 moves timing control lever 38 in a nonpivotal manner into the position shown in FIG. 4A. The operation of this embodiment to place the assembly in the retarded timing mode should be evident from the discussion hereinabove. This embodiment is advantageous for providing a more simplified and perhaps less expensive design but results in only two timing positions/modes instead of the infinitely variable control provided by the first embodiment of FIGS. 1–3.

Figure 4A:
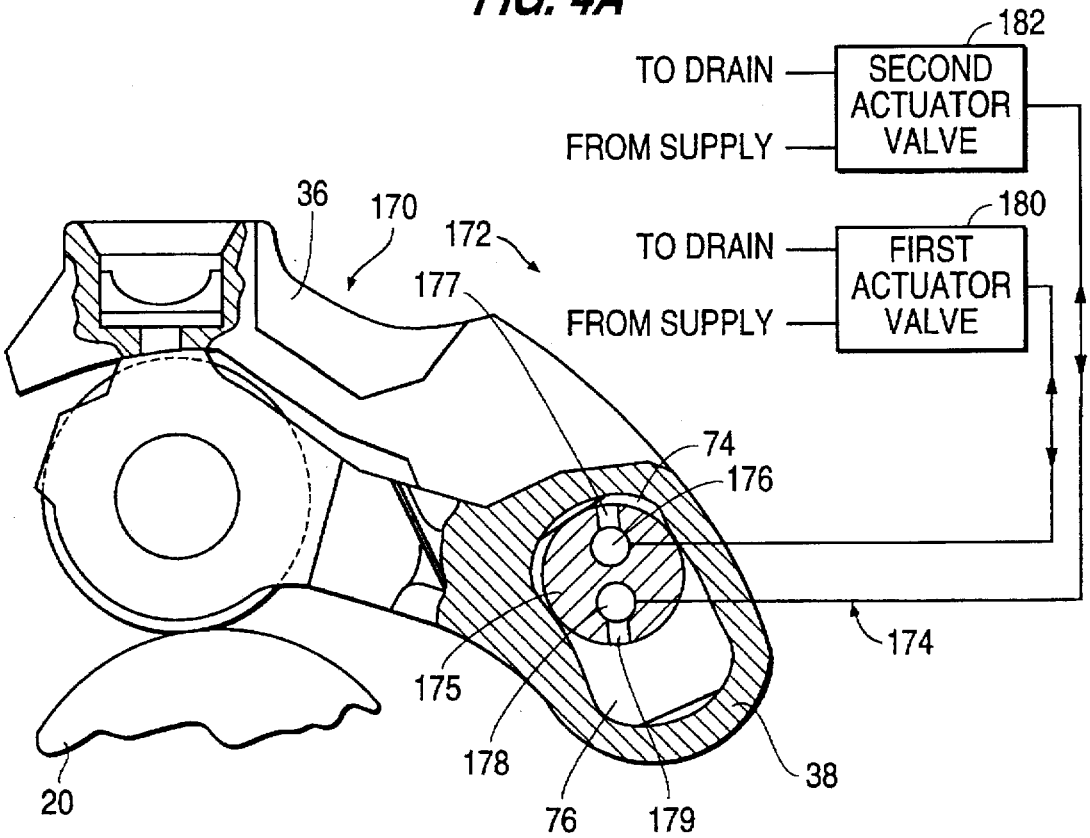
FIGS. 4A and 4B are partial cross-sectional side views of the cam follower lever mechanism in accordance with a second embodiment of the present invention showing the cam follower lever positioned to provide regular timing and advanced timing, respectively.
Figure 4B:
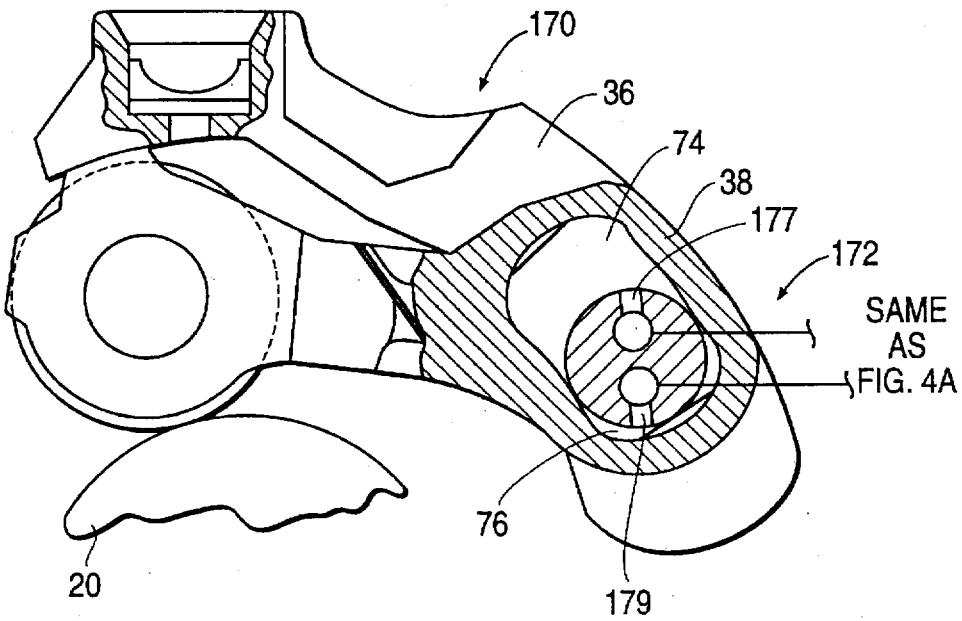

FIG. 5A as discussed hereinabove illustrates levers 36, 38 of the second embodiment shown in FIGS. 4A and 4B assembled. FIGS. 5B and 5C illustrate the force transmitting lever 36 and the timing control lever 38, respectively, in unassembled form.

Cam follower lever assembly 10 of the present invention permits the timing of operation of an engine component to be varied while also moving the engine component to a substantially constant outer stroke limit while roller 50 is on the outer base circle of cam 20 regardless of the nonpivotal timing position of timing control lever 38. In other words, the maximum amount of actuation lift imparted by the outer base circle of cam 20 is not affected by the movement of timing control lever 38 along the outer surface of cam 20 into various timing positions. It should be understood that as second end 44 of timing control lever 38 moves along the outer surface of cam 20 into different timing positions, mating surface 52 moves relative to force transmitting surface 68. A constant actuation lift or stroke limit is achieved by forming force transmitting surface 68 and positioning force transmitting lever 36 relative to cam 20 such that force transmitting surface 68 forms an arc having a radius with a center of origin lying on cam axis 21. Thus, regardless of the position of mating surface 52 along force transmitting surface 68 at least when the roller 50 is on the outer base circle of cam 20, the radius of curvature $r_1$ of force transmitting surface 68 as measured from cam axis 21, remains substantially constant. Thus, shifting the timing control lever 38 to vary the timing of operation of the engine component, i.e. injector, does not change the radius of curvature $r_1$ of force transmitting surface 68 and thus moves the engine component, i.e. injector plunger, to a constant outer stroke limit. Thus, the present cam follower lever assembly permits variations in the timing of injection while maintaining substantially constant mechanical crush between the injector plunger and the injector body at the downward end stroke of the injector plunger.

Cam follower lever assembly 10 as applied to a unit injector having a purely mechanical connection between the injector drive train and the innermost injection plunger, functions to minimize parasitic losses and fuel heating problems associated with multi-plunger unit injectors having a variable volume timing chamber for varying injection timing. However, to meet future emissions and performance requirements, it now appears that it will be necessary to be able to control injection pressure independently of injection timing, thereby enabling, for example, the injection pressure to be maintained constant despite a change in timing, and such cannot be achieved with a fuel injector having a purely mechanical driven injection plunger. Thus, cam follower lever assembly 10 may be used in combination with a multi-plunger fuel injector having a variable volume timing chamber, such as disclosed in U.S. Pat. No. 4,986,472 to Warlick et al. and U.S. Pat. No. 4,531,672 to Smith both of which are hereby incorporated by reference. In these types of injectors, when timing is advanced by increasing the size of the hydraulic link formed by the timing chamber, the injection event occurs at a higher cam shaft velocity than at retarded timing. By combining the cam follower lever assembly 10 of the present invention with a multi-plunger type unit fuel injector having a timing chamber, another degree of freedom is obtained which permits variable pressure to be achieved in addition to variable timing. The start of injection will commence at a constant cam velocity irrespective of any advance or retarding of engine timing. From this point, cam follower lever assembly 10 and the timing chamber (variable hydraulic link) of the multi-plunger injector can be used separately and/or together to control the velocity of the injection plunger and thus the pressure of injection so as to achieve a low average velocity/pressure or a high average velocity/pressure for any given engine timing selected. As a result, this combination permits the control of the injection rate (injection rate shaping) while varying injection timing.

While various embodiments in accordance with the present invention have been shown and described, it is understood that the invention is not limited thereto, and is susceptible to numerous changes and modifications as known to those skilled in the art.

Industrial Applicability

The variable timing cam follower lever assembly of the present invention may be used in compression ignition and spark ignition engines of any vehicle or industrial equipment where accurate and reliable control and variation of the timing of operation of an engine component is desired. The variable timing cam follower lever assembly of the present invention is particularly useful in controlling the timing of operation of unit fuel injector plungers so as to variably control the timing of fuel injection.

We claim:

1. A cam follower lever mechanism for transmitting an actuating force from a cam, having an outer surface, to an engine component so as to move the engine component through an actuation stroke having a predetermined outer extension limit during each rotation of the cam while permitting variations in the timing of operation of the engine component, comprising:

a pivot support mounted adjacent the cam to define a pivot axis;

a follower lever means mounted on said pivot support for pivotal movement about said pivot axis, said follower lever means including a timing control lever mounted for nonpivotal movement relative to said pivot axis and including a first end pivotally connected to said pivot support and a second end positioned for abutment against the cam outer surface, said nonpivotal movement of said timing control lever causing said second end to move along the cam outer surface while maintaining said pivot axis stationary relative to the cam and maintaining the predetermined outer extension limit of the actuation stroke substantially constant.

2. The cam follower mechanism of claim 1, wherein said follower lever means further includes a force transmitting lever including a pivot end pivotally connected to said pivot support and a support end positioned adjacent said second end of said timing control lever for receiving the actuating force from said second end of said timing control lever.

3. The cam follower mechanism of claim 2, wherein said pivot end of said force transmitting lever includes a first arm pivotally mounted on said pivot support and a second arm pivotally mounted on said pivot support a spaced distance from said first arm, said first end of said timing control lever being mounted on said pivot support between said first and second arms.

4. The cam follower mechanism of claim 1, further including an actuating means for causing the nonpivotal movement of said timing control lever along the outer surface of the cam to vary the timing of operation of the engine component, said actuating means including a pressurized supply of actuating fluid and at least one actuator cavity formed in said timing control lever for receiving actuating fluid.

5. The cam follower mechanism of claim 4, wherein said actuating means further includes a control valve means for varying the amount of fluid in said at least one actuator cavity to cause the nonpivotal movement of said first end of said timing control lever for varying the timing of operation of the engine component.

6. The cam follower mechanism of claim 4, wherein said at least one actuator cavity includes a first actuator cavity formed in said timing control lever on one side of said pivot support for receiving actuating fluid and a second actuator cavity formed on an opposite side of said pivot support for receiving actuating fluid.

7. The cam follower mechanism of claim 5, wherein said control valve means includes a valve cavity formed in said timing control lever and a spring-biased valve plunger positioned in said valve cavity, further including a fluid supply passage means formed in said pivot support and said timing control lever for delivering actuating fluid to said valve cavity and fluid transfer passages formed in said timing control lever for connecting said valve cavity with said at least one actuator cavity.

8. The cam follower mechanism of claim 7, wherein said actuating means further includes a pressure regulator for selectively varying the supply pressure of the actuating fluid delivered to said valve cavity, said valve plunger being movable in response to changes in the supply pressure to vary the amount of fluid in said at least one actuator cavity.

9. The cam follower mechanism of claim 6, wherein said pivot support includes a pivot shaft, said first end of said timing control lever including an oblong aperture for receiving said pivot shaft, said timing control lever including sealing surfaces forming said oblong aperture for creating a fluid seal between said pivot shaft and said timing control lever to prevent fluid leakage between said first and said second actuator cavities.

10. The cam follower mechanism of claim 6, wherein said pivot support includes a first fluid transfer passage communicating with said first actuator cavity and a second fluid transfer passage communicating with said second actuator cavity for transferring fluid into and out of said first and said second cavities, respectively.

11. A cam follower lever mechanism for transmitting an actuating force from a cam, having an outer surface, to an engine component while permitting variations in the timing of operation of the engine component, comprising:

a pivot support mounted adjacent the cam to define a pivot axis;

a follower lever means mounted on said pivot support for pivotal movement about said pivot axis, said follower lever means including a timing control lever mounted for nonpivotal movement relative to said pivot axis, said timing control lever including a first end connected to said pivot support for pivotal and nonpivotal movement relative to said pivot axis and a second end positioned a spaced distance from said first end in abutment with the outer surface of the cam and movable along the outer surface of the cam;

an actuating means for causing the nonpivotal movement of said timing control lever along the outer surface of the cam to vary the timing of operation of the engine component, said actuating means including a pressurized supply of actuating fluid, at least one actuator cavity formed in said timing control lever for receiving actuating fluid and a control valve means for varying the amount of fluid in said at least one actuator cavity to cause the nonpivotal movement of said first end of said timing control lever for varying the timing of operation of the engine component.

12. The cam follower mechanism of claim 11, wherein said follower lever means further includes a force transmitting lever including a pivot end pivotally connected to said pivot support and a support end positioned adjacent said second end of said timing control lever for receiving the actuating force from said second end of said timing control lever.

13. The cam follower mechanism of claim 12, wherein said pivot end of said force transmitting lever includes a first arm pivotally mounted on said pivot support and a second arm pivotally mounted on said pivot support a space distance from said first arm, said first end of said timing control lever being mounted on said pivot support between said first and second arms.

14. The cam follower mechanism of claim 11, wherein said at least one actuator cavity includes a first actuator cavity formed in said timing control lever on one side of said pivot support for receiving actuating fluid and a second actuator cavity formed on an opposite side of said pivot support for receiving actuating fluid.

15. The cam follower mechanism of claim 11, wherein said control valve means includes a valve cavity formed in said timing control lever and a valve plunger positioned in said valve cavity, further including a fluid supply passage formed in said pivot support for delivering actuating fluid to said valve cavity and fluid transfer passages formed in said timing control lever for connecting said valve cavity with said at least one actuator cavity.

16. The cam follower mechanism of claim 15, wherein said actuating means further includes a pressure regulator for selectively varying the supply pressure of the actuating fluid delivered to said valve cavity, said valve plunger being movable in response to changes in the supply pressure.

17. The cam follower mechanism of claim 14, wherein said pivot support includes a pivot shaft, said first end of said timing control lever including an oblong aperture for receiving said pivot shaft, said timing control lever including sealing surfaces forming said oblong aperture for creating a fluid seal between said pivot shaft and said timing control lever to prevent fluid leakage between said first and said second actuator cavities.

18. The cam follower mechanism of claim 14, wherein said pivot support includes a first fluid transfer passage communicating with said first actuator cavity and a second fluid transfer passage communicating with said second actuator cavity for transferring fluid into and out of said first and said second cavities, respectively.

19. A cam follower lever mechanism for transmitting an actuating force from a cam, having an outer surface, to an engine component while permitting variations in the timing of operation of the engine component, comprising:

a pivot support mounted adjacent the cam to define a pivot axis;

a follower lever means mounted on said pivot support for pivotal movement about said pivot axis, said follower lever means including a timing control lever mounted for pivotal and nonpivotal movement relative to said pivot axis;

an actuating means for causing the nonpivotal movement of said timing control lever to vary the timing of operation of the engine component, said actuating means including a pressurized supply of actuating fluid, a first actuator cavity formed in said timing control lever on one side of said pivot support for receiving actuating fluid, a second actuator cavity formed on an opposite of said pivot support for receiving actuating fluid, and a control valve means for controlling the amount of fluid in said first and said second actuator cavities to cause the nonpivotal movement of said timing control lever for varying the timing of operation of the engine component.

20. The cam follower mechanism of claim 19, wherein said follower lever means further includes a force transmitting lever including a pivot end pivotally connected to said pivot support and a support end positioned adjacent said second end of said timing control lever for receiving the actuating force from said second end of said timing control lever.

21. The cam follower mechanism of claim 20, wherein said pivot end of said force transmitting lever includes a first arm pivotally mounted on said pivot support and a second arm pivotally mounted on said pivot support a space distance from said first arm, said first end of said timing control lever being mounted on said pivot support between said first and second arms.

22. The cam follower mechanism of claim 19, wherein said control valve means includes a valve cavity formed in said timing control lever and a valve plunger positioned in said valve cavity, further including a fluid supply passage formed in said pivot support for delivering actuating fluid to said valve cavity and fluid transfer passages formed in said timing control lever for connecting said valve cavity with said at least one actuator cavity.

23. The cam follower mechanism of claim 22, wherein said actuating means further includes a pressure regulator for selectively varying the supply pressure of the actuating fluid delivered to said valve cavity, said valve plunger being movable in response to changes in the supply pressure.

24. The cam follower mechanism of claim 19, wherein said pivot support includes a pivot shaft, said first end of said timing control lever including an oblong aperture for receiving said pivot shaft, said timing control lever including sealing surfaces forming said oblong aperture for creating a fluid seal between said pivot shaft and said timing control lever to prevent fluid leakage between said first and said second actuator cavities.

25. The cam follower mechanism of claim 19, wherein said pivot support includes a first fluid transfer passage communicating with said first actuator cavity and a second fluid transfer passage communicating with said second actuator cavity for transferring fluid into and out of said first and said second cavities, respectively.

* * * * *